US005860396A

United States Patent [19]

Muth

[11] Patent Number: 5,860,396

[45] Date of Patent: Jan. 19, 1999

[54] ENGINE BLOW-BY OIL RESERVOIR

[76] Inventor: George R. Muth, 36550 Bailey Rd., Pomeroy, Ohio 45769

[21] Appl. No.: 927,339

[22] Filed: Sep. 11, 1997

[51] Int. Cl.[6] ..... F01M 13/00

[52] U.S. Cl. ..... 123/41.86

[58] Field of Search ..... 123/41.86, 572, 123/573, 574

[56] References Cited

U.S. PATENT DOCUMENTS

| | | | |
|---|---|---|---|
| 3,834,365 | 9/1974 | Ussery | 123/41.86 |
| 4,920,930 | 5/1990 | Sakano et al. | 123/41.86 |
| 5,417,184 | 5/1995 | McDowll | 123/41.86 |
| 5,479,907 | 1/1996 | Walker | 123/41.86 |

*Primary Examiner*—Marguerite McMahon

[57] ABSTRACT

An oil blow-by reservoir is provided including a blow by tube of an engine with oil passing therethrough. Also included is a container with at least one mounting bracket for mounting the container to the engine. At least one vent is formed in a top face of container. An oil deflector is included for preventing oil from exiting the container upon the release of pressure from within the container. An oil inlet is formed in the container and connected to the blow by tube for receiving oil therefrom. Finally, an oil release valve is connected to the container for allowing the selective removal of oil from the container.

4 Claims, 2 Drawing Sheets

ENGINE BLOW-BY OIL RESERVOIR

BACKGROUND OF THE INVENTION

1. Field of the Invention

The present invention relates to oil containers and more particularly pertains to a new engine blow-by oil reservoir for preventing the leakage of oil from a diesel engine or the like in any one of various applications for the purpose of protecting the environment and further preventing road safety hazards.

2. Description of the Prior Art

The use of oil containers is known in the prior art. More specifically, oil containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art oil containers include U.S. Pat. No. 4,723,529; U.S. Pat. No. 5,417,184; U.S. Pat. No. 4,881,510; U.S. Pat. No. 5,383,440; U.S. Pat. No. 5,277,154; and U.S. Pat. No. Des. 344,278.

In these respects, the engine blow-by oil reservoir according to the present invention substantially departs from the conventional concepts and designs of the prior art, and in so doing provides an apparatus primarily developed for the purpose of preventing the leakage of oil from a diesel engine or the like in any one of various applications for the purpose of protecting the environment and further preventing safety hazards.

SUMMARY OF THE INVENTION

In view of the foregoing disadvantages inherent in the known types of oil containers now present in the prior art, the present invention provides a new engine blow-by oil reservoir construction wherein the same can be utilized for preventing the leakage of oil from a diesel engine or the like in any one of various applications for the purpose of protecting the environment and further preventing safety hazards.

The general purpose of the present invention, which will be described subsequently in greater detail, is to provide a new engine blow-by oil reservoir apparatus and method which has many of the advantages of the oil containers mentioned heretofore and many novel features that result in a new engine blow-by oil reservoir which is not anticipated, rendered obvious, suggested, or even implied by any of the prior art oil containers, either alone or in any combination thereof.

To attain this, the present invention generally comprises a blow by tube of an engine with oil passing therethrough. A container is provided with a cylindrical configuration. As best shown in FIG. 4, the container has a circular bottom face and a cylindrical periphery coupled to the bottom face and extended upwardly therefrom defining an interior space. A circular top face is removably situated over an open top of the container with a gasket situated therebetween for sealing purposes. Next provided is a pair of annular mounting brackets each having a pair of free ends. Such free ends have parallel extents with a pair of aligned apertures formed therein, as shown in FIG. 2. Further, the free ends define a pair of collinear extents with a pair of bores formed in ends thereof for coupling with the engine by way of bolts. The apertures of the parallel extents are adapted for allowing the tightening of the annular brackets via a nut and bolt about a top portion and a bottom portion of the container. As such, the container is held in place about a vertical axis with respect to the engine during use. As shown in FIGS. 1 & 2, a pair of air vents are formed in the top face of container. An oil deflector assembly is provided including central rod having a first end coupled to the top face of the container in concentric relationship therewith. Note FIG. 4. The rod further has a second end coupled to the bottom face of the container in concentric relationship therewith. A first oil deflector is coaxially coupled to the central rod adjacent the top face of the container. The first deflector is defined by a portion of a sphere and has an open bottom facing downwardly and a diameter less than that of the interior space of the container. Associated therewith is a second oil deflector coaxially coupled to the central rod below the first deflector. Similar to the first deflector, the second deflector is defined by a portion of a sphere. Further, the second deflector is equipped with an open top facing upward and a diameter equal to that of the interior space of the container. For reasons that will become apparent later, the second deflector has a plurality of apertures formed therein in a circular configuration. Next provided is an oil inlet tube having an upper end fixed within an eccentric bore formed in the top face of the container. A remaining portion of the inlet tube is extended through a pair of aligned openings formed in the oil deflectors. The upper end of the oil inlet tube has an elbow joint coupled thereto which is, in turn, coupled to a tube connected to the blow by tube for receiving oil therefrom. By this structure, oil is forced toward a lower extent of the container and excess pressure is released through the apertures of the second oil deflector and around the periphery of the first oil deflector for exiting through the air vents. The oil is contained between the deflectors for draining through the apertures of the second oil deflector when pressure is absent within the container. For allowing the selective removal of oil, an oil release valve is situated on an exterior of the bottom face of the container. The oil release valve is equipped with an associated lever having a first orientation for releasing oil from the container and a second orientation for precluding the removal of oil from the container. Finally, an oil level indicator is provided including a pair of contacts coupled to the periphery of the container at a midpoint thereof. During use, the contacts are adapted to relay a signal upon the continues detection of oil for providing an indication to a user that the container must be drained.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new engine blow-by oil reservoir apparatus and method which has many of the advantages of the oil containers mentioned heretofore and many novel features that result in a new engine blow-by oil reservoir which is not anticipated, rendered obvious, suggested, or even implied by any of the prior art oil containers, either alone or in any combination thereof.

It is another object of the present invention to provide a new engine blow-by oil reservoir which may be easily and efficiently manufactured and marketed.

It is a further object of the present invention to provide a new engine blow-by oil reservoir which is of a durable and reliable construction.

An even further object of the present invention is to provide a new engine blow-by oil reservoir which is susceptible of a low cost of manufacture with regard to both materials and labor, and which accordingly is then susceptible of low prices of sale to the consuming public, thereby making such engine blow-by oil reservoir economically available to the buying public.

Still yet another object of the present invention is to provide a new engine blow-by oil reservoir which provides in the apparatuses and methods of the prior art some of the advantages thereof, while simultaneously overcoming some of the disadvantages normally associated therewith.

Still another object of the present invention is to provide a new engine blow-by oil reservoir for preventing the leakage of oil from a diesel engine or the like in any one of various applications for the purpose of protecting the environment and further preventing safety hazards.

Even still another object of the present invention is to provide a new engine blow-by oil reservoir that includes a blow by tube of an engine with oil passing therethrough. Also included is a container with at least one mounting bracket for mounting the container to the engine. At least one vent is formed in a top face of container. An oil deflector is included for preventing oil from exiting the container upon the release of pressure from within the container. An oil inlet is formed in the container and connected to the blow by tube for receiving oil therefrom. Finally, an oil release valve is connected to the container for allowing the selective removal of oil from the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
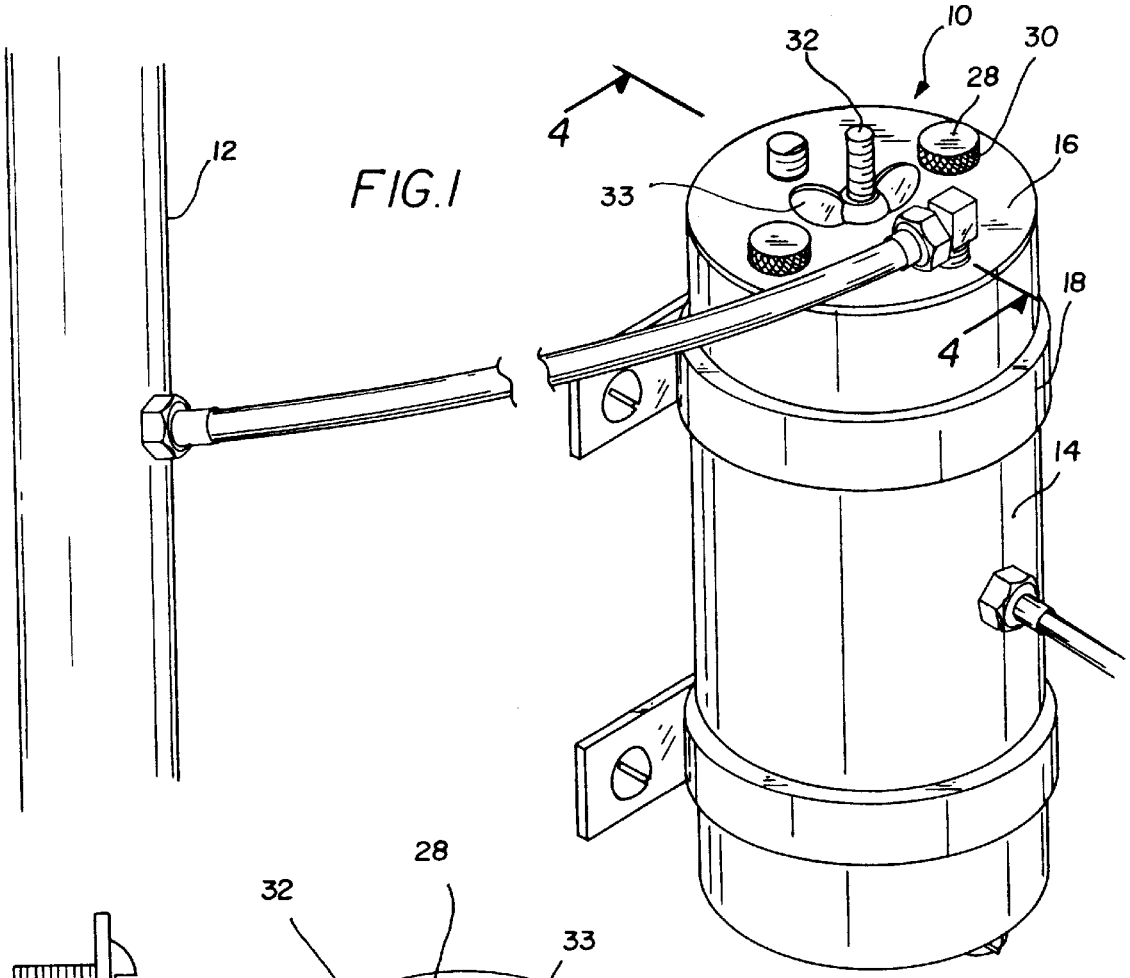
FIG. 1 is a perspective view of a new engine blow-by oil reservoir according to the present invention.

With reference now to the drawings, and in particular to FIGS. 1 through 4 thereof, a new engine blow-by oil reservoir embodying the principles and concepts of the present invention and generally designated by the reference numeral 10 will be described.

Figure 4:
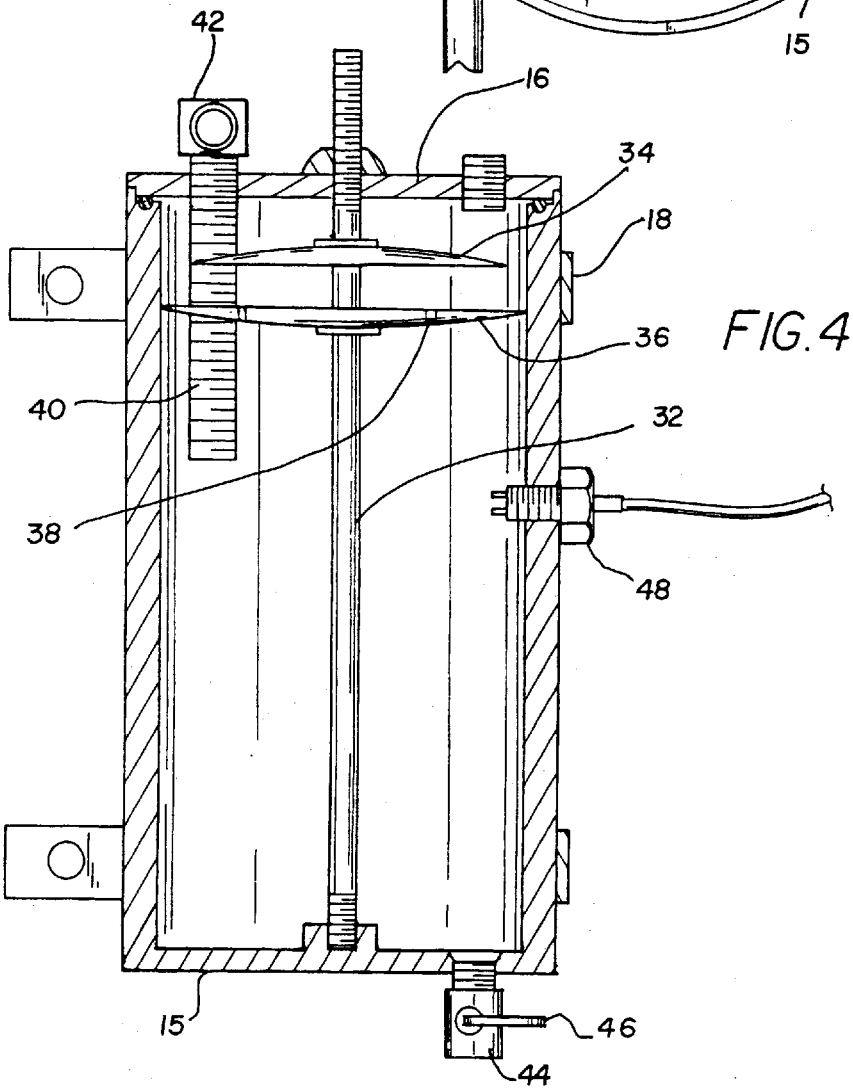
FIG. 4 is a cross-sectional view of the present invention taken along line 4—4 shown in FIG. 1.

The present invention, as designated as numeral 10, includes a blow by tube 12 of an engine with oil passing therethrough. A container 14 is provided with a cylindrical configuration. As best shown in FIG. 4, the container has a circular bottom face 15 and a cylindrical periphery fixedly coupled to the bottom face and extended upwardly therefrom defining an interior space. A circular top face 16 is removably situated over an open top of the container with a gasket situated therebetween for sealing purposes.

Figure 2:
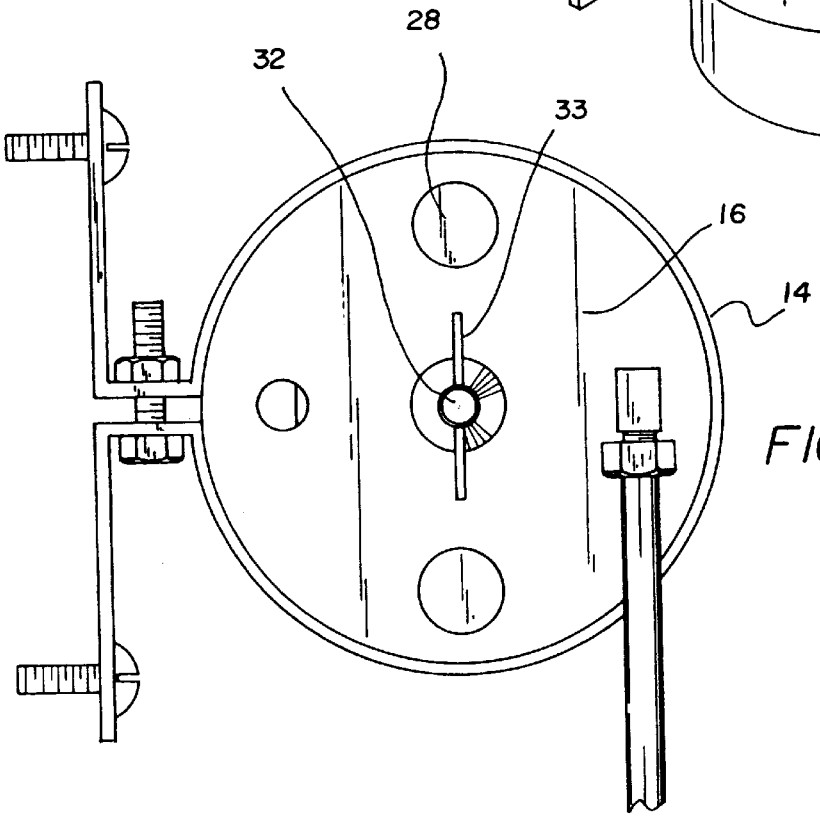
FIG. 2 is a top view of the present invention.
Figure 3:
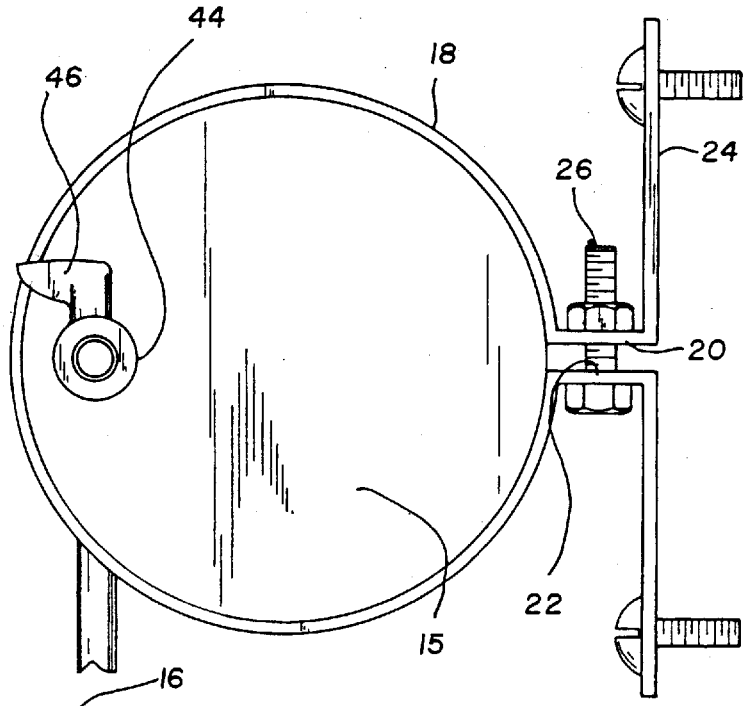
FIG. 3 is a bottom view of the present invention.

Next provided is a pair of annular mounting brackets 18 each having a pair of free ends. Such free ends have parallel extents 20 with a pair of aligned apertures 22 formed therein, as shown in FIGS. 2 & 3. Further, the free ends define a pair of collinear extents 24 with a pair of bores formed in ends thereof for coupling with the engine by way of bolts. The apertures of the parallel extents are adapted for allowing the tightening of the annular brackets via a nut and bolt 26 about a top portion and a bottom portion of the container. As such, the container is held in place about a vertical axis with respect to the engine during use.

As shown in FIGS. 1 & 2, a pair of air vents 28 are formed in the top face of container. The air vents are selectively closed by way of bolts 30. It should be noted, however, that the vents must be open during use. As an option, an additional fitting may be situated on the top face of the container for coupling with a device for measuring an amount of pressure therein.

An oil deflector assembly is provided including central rod 32 having a first end coupled to the top face of the container in concentric relationship therewith. Note FIG. 4. The rod further has a second end coupled to the bottom face of the container in concentric relationship therewith. Preferably, the coupling between the rod and the bottom of the container are of a screwable type. Further, a wing nut 33 is preferably screwably coupled to a top end of the rod for forcing the top face against the remaining portion of the container.

A first oil deflector 34 is coaxially and fixedly coupled to the central rod adjacent the top face of the container. The first deflector is defined by a portion of a sphere and has an open bottom facing downwardly and a diameter less than that of the interior space of the container. Associated therewith is a second oil deflector 36 fixedly and coaxially coupled to the central rod below the first deflector. Similar to the first deflector, the second deflector is defined by a portion of a sphere. Further, the second deflector is equipped with an open top facing upward and a diameter equal to that of the interior space of the container. For reasons that will become apparent later, the second deflector has a plurality of apertures 38 formed therein in a circular configuration.

Next provided is an oil inlet tube 40 having an upper end fixed within an eccentric bore formed in the top face of the container. A remaining portion of the inlet tube is extended through a pair of aligned openings formed in the oil deflectors. The upper end of the oil inlet tube has an elbow joint 42 coupled thereto which is, in turn, coupled to a tube connected to the blow by tube for receiving oil therefrom.

By this structure, oil is forced toward a lower extent of the container and excess pressure is released through the apertures of the second oil deflector and around the periphery of the first oil deflector for exiting through the air vents. Any oil accompanying flowing air is contained between the deflectors for draining through the apertures of the second oil deflector when pressure is absent within the container.

For allowing the selective removal of oil, an oil release valve 44 is situated on an exterior of the bottom face of the container. The oil release valve is equipped with an associated lever 46 having a first orientation for releasing oil from the container and a second orientation for precluding the removal of oil from the container.

Finally, an oil level indicator 48 is provided including a pair of contacts coupled to the periphery of the container at a midpoint thereof. During use, the contacts are adapted to relay a signal upon the continues detection of oil for providing an indication to a user that the container must be drained. It should be noted that the signal may be utilized to trigger any one of various types of indicators such as a dash mounted light or the like. To prevent false alarms, it is preferred that the oil inlet tube be situated adjacent a side of the periphery of the container opposite the indicator. Further, the inlet tube ideally extends downwardly to a point approximately at an elevation common with the indicator 48.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An oil blow-by reservoir comprising, in combination:

a blow by tube of an engine with oil passing therethrough;

a container with a cylindrical configuration having a circular bottom face, a cylindrical periphery coupled to the bottom face and extending upwardly therefrom defining an interior space, and a circular top face removably situated over an open top of the container with a gasket situated therebetween for sealing purposes;

a pair of annular mounting brackets each having a pair of free ends having parallel extents with a pair of aligned apertures formed therein and a pair of collinear extents with a pair of bores formed in ends thereof for coupling with the engine, the apertures of the parallel extents adapted for allowing the tightening of the annular brackets about a top portion and a bottom portion of the container such that the container is held in place about a vertical axis with respect to the engine;

a pair of air vents formed in the top face of container;

a oil deflector assembly including central rod having a first end coupled to the top face of the container in concentric relationship therewith, a second end coupled to the bottom face of the container in concentric relationship therewith, a first oil deflector coaxially coupled to the central rod adjacent the top face of the container with the first deflector defined by a portion of a sphere and having an open bottom facing downwardly and a diameter less than that of the interior space of the container, and a second oil deflector coaxially coupled to the central rod below the first deflector with the second deflector defined by a portion of a sphere and having an open top facing upward and a diameter equal to that of the interior space of the container, the second deflector having a plurality of apertures formed therein in a circular configuration;

an oil inlet tube having an upper end fixed within an eccentric bore formed in the top face of the container and extended through a pair of aligned openings formed in the oil deflectors, the upper end of the oil inlet tube having an elbow joint coupled thereto which is in turn coupled to a tube connected to the blow by tube for receiving oil therefrom, whereby oil is forced toward a lower extent of the container and excess pressure is released through the apertures of the second oil deflector and around the periphery of the first oil deflector for exiting through the air vents such that the oil is contained between the deflectors for draining through the apertures of the second oil deflector when pressure is absent within the container;

an oil release valve situated on an exterior of the bottom face of the container with an associated lever having a first orientation for releasing oil from the container and a second orientation for precluding the removal of oil from the container; and an oil level indicator including a pair of contacts coupled to the periphery of the container at a midpoint thereof, the contacts adapted to relay a signal upon the continues detection of oil for providing an indication to a user that the container must be drained.

2. An oil blow-by reservoir comprising:

a blow by tube of an engine with oil passing therethrough;

a container, at least one vent formed in the container;

a pair of oil deflectors for preventing oil from exiting the container, wherein one of the deflectors has apertures formed therein and each of the deflectors are defined by a portion of sphere with concave faces of the deflectors facing each other;

an oil inlet formed in the container and connected to the blow by tube for receiving oil therefrom; and an oil release valve for allowing the selective removal of oil from the container.

3. An oil blow-by reservoir as set forth in claim 2 wherein an oil level indicator is provided for providing an indication to a user that the container must be drained.

4. An oil blow-by reservoir as set forth in claim 2 wherein the oil release valve has a first orientation for releasing oil from the container and a second orientation for precluding the removal of oil from the container.

* * * * *